US006053165A

United States Patent [19]

Butler et al.

[11] Patent Number: 6,053,165

[45] Date of Patent: Apr. 25, 2000

[54] SIMULATED ELECTRIC GLOWING EMBERS FOR GAS FIREPLACES

[75] Inventors: Gary Lee Butler, Silver Lake; David Charles Lyons, Red Wing; Ronald John Shimek, Prior Lake; Robb Edward Bennett, Jordan, all of Minn.

[73] Assignee: Heat-N-Glo Fireplace Products, Inc., Lakeville, Minn.

[21] Appl. No.: 09/229,951

[22] Filed: Jan. 13, 1999

[51] Int. Cl.[7] ..... F24C 3/00

[52] U.S. Cl. ..... 126/512; 126/500; 40/428

[58] Field of Search ..... 126/500, 512; 40/428

[56] References Cited

U.S. PATENT DOCUMENTS

| | | | |
|---|---|---|---|
| 1,470,253 | 10/1923 | Berry | 40/428 |
| 1,567,855 | 12/1925 | Meany et al. | 40/428 |
| 1,692,021 | 11/1928 | Auer | 40/428 |
| 1,992,540 | 2/1935 | Newton | 40/428 |
| 2,684,244 | 7/1954 | Brooks | 40/428 |
| 4,890,600 | 1/1990 | Meyers | 126/512 |
| 5,642,580 | 7/1997 | Hess et al. | 40/428 |

FOREIGN PATENT DOCUMENTS

| | | | |
|---|---|---|---|
| 249321 | 3/1926 | United Kingdom | 40/428 |

*Primary Examiner*—Carroll Dority
*Attorney, Agent, or Firm*—John B. Sowell-Aty

[57] ABSTRACT

A low cost prefabricated fireplace is provided with an open-ended fireplace box which requires no outer sheet metal shroud or housing as employed in the prior art sheet metal fireplaces. The novel fireplace box has at least five walls which consist substantially of insulating reinforced ceramic fiber (RCF) material and a binder. A modular burner system is removably mounted on the bottom wall of the fireplace box and a floor panel is mounted on the modular burner system forming an air chamber below the floor panel in the fireplace box. A decorative surround trim is attached to the open end of the fireplace box which serves to support fixed or operable glass doors. A log set which may include a log burner is mounted above the floor panel which supports a decorative log set. Apertures are made in the top sides or of the fireplace box to accommodate an air supply and/or an exhaust stack. The fireplace box serves as a base unit to which other fireplace components are attached, connected or supported so that the need for conventional sheet metal is substantially eliminated. The resulting fireplace can be completed in many different configurations using a common fireplace box which needs no additional surrounding insulation for installation in a room.

17 Claims, 8 Drawing Sheets

SIMULATED ELECTRIC GLOWING EMBERS FOR GAS FIREPLACES

BACKGROUND OF THE INVENTION

1. Field of the Invention

The present invention relates to gas fireplaces and burners for gas fireplaces. More particularly, the present invention relates to a real gas fireplace which may be turned on or off while maintaining a realistic simulation of glowing embers and burning logs.

2. Description of the Prior Art

It was known to those skilled in the movie lighting art that scenes are filmed with flickering light illumination sources to realistically convey that the scene being filmed is subject to light from a fireplace. Manufacturers of electrical lighting circuits have been able to manufacture light sources which cause ordinary light to display a flickering effect. It is also known that certain manufacturers of incandescent light bulbs have been able to build into the light a flicker effect.

It is also known that mechanical flickering screens may be placed under gas logs between a light and the logs so that a repeatable pattern of flickering light is cast upon the log. This type of simulation appears to be artificial and unreal.

It would be desirable to provide a source of random patterned flickering light which is cast directly onto real logs or artificial gas logs so as to realistically simulate the burning of coals and embers under a log set and to simulate the burning of logs.

SUMMARY OF THE INVENTION

It is a primary object of the present invention to provide an electrical source of random flickering light which is cast directly onto a log set in a fireplace to simulate burning logs.

It is another primary object of the present invention to provide a glowing bed of embers which serves as a random and controllable electric source of flickering light.

It is a primary object of the present invention to provide a novel electric simulated glowing embers light source.

It is a primary object of the present invention to provide a means for projecting a simulated bed of glowing embers pattern onto a log set.

It is a primary object of the present invention to provide an artificial bed of glowing embers which is resistant to high temperatures and may be operated inside or at the floor of a gas fireplace combustion chamber.

It is another primary bed of glowing embers through which a source of flickering light is projected directly onto a log set to simulate the burning of logs and also glowing embers without heat.

It is a general object to create the illusion of light produced by burning logs without heat.

It is a general object to provide a translucent bed of glowing embers by molding glass or a mixture of glass particles bonded together by high temperature adhesive or glass frit.

It is another object of the present invention to provide a colored pattern on or under a translucent bed of glowing ember that may be projected as light onto a log set.

DESCRIPTION OF THE PREFERRED EMBODIMENTS

Figure 1:
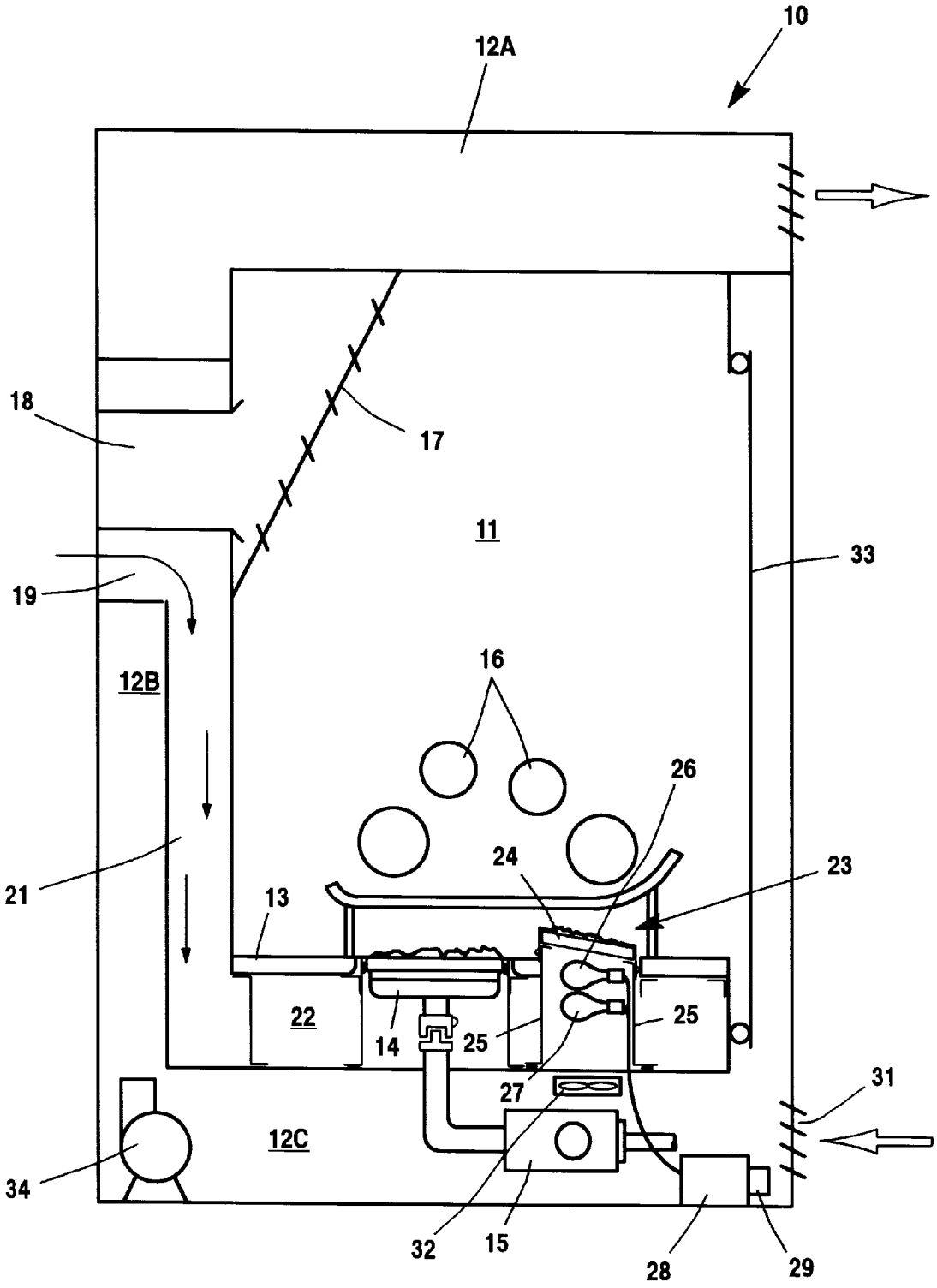
FIG. 1 is a side elevation in section of a typical direct vent gas fireplace showing one location of the present invention simulated glowing electric embers.

Refer now to FIG. 1 showing a side elevation in section of a fireplace 10 comprising a combustion chamber 11 which is surrounded by a heat exchanger 12 shown by the numerals 12A, 12B and 12C. A raised floor 13 in the combustion chamber 11 is approximately at the same level as the burner 14. The gas chamber 14 is shown connected to a gas control valve 15 for producing gas flames which pass up and through the log 16. The product of combustion is passed through the baffle 17 and out the exhaust 18. Fresh combustion air enters through the coaxial duct 19 and comes down through the duct 21 into the combustion air chamber 22 under the raised floor 13. Thus, it will be appreciated that the fireplace 10 may be operated as a conventional fireplace which gives out heat and burns gas with the appearance of burning logs. When it is desired to operate the fireplace in a mode of operation that produces the minimum amount of heat, the gas supply at the control valve may be terminated and the electric glowing embers 23 may be turned on so that no heat is supplied to the room area. The electric glowing embers 23 are shown comprising a translucent panel 24 which is mounted on legs 25 at approximately the same level as the floor 13 and burner 14. Beneath the translucent panel 24, there is provided one or more flickering light sources 26. In the preferred embodiment of the present invention, the auxiliary light source 27 may be provided. Light sources 25 and 27 are shown connected to a control box 28 which is provided with an on/off switch 29 located behind the removable intake panel 31. In the present embodiment shown, it is possible to simultaneously operate the gas burner and the flickering light sources 26, 27 to provide very low heat and create the illusion of an extremely hot fire. A fan 32 may be provided in the embodiment shown so as to operate the fireplace in a hot heat mode with the flickering light sources protected by the cooling effect of the fan 32 and/or the circulation of air through the heat exchanger 12.

In the preferred embodiment of the present invention, the translucent panel is preferably made of a heat resistant glass and is provided with 3-dimensional contours on the upper surface in the form of glowing coals. This may be accomplished by starting with a flat plate of high temperature glass, adding thereon a mixture of high temperature glass and a glass frit which is molded and bonded onto the base panel. Another method of producing the novel translucent glowing embers panel is to start with a sheet of high temperature glass and reheat it in a ceramic oven allowing it to form or be formed in a negative mold having 3-dimensional contours that resemble glowing goals. Yet another process for producing the novel panel 24 is to start with a flat sheet of high temperature glass and bond a glass powder mixture onto the glass with high temperature adhesives. Having explained the preferred methods of making glowing embers panel 24, it will be possible to use variations of these method steps to produce the panel by other methods.

The direct vent fireplace 10 shown in FIG. 1 is provided with a fixed glass door 33 and a blower motor 34 in the heat exchanger to complete an operable fireplace.

Figure 2:
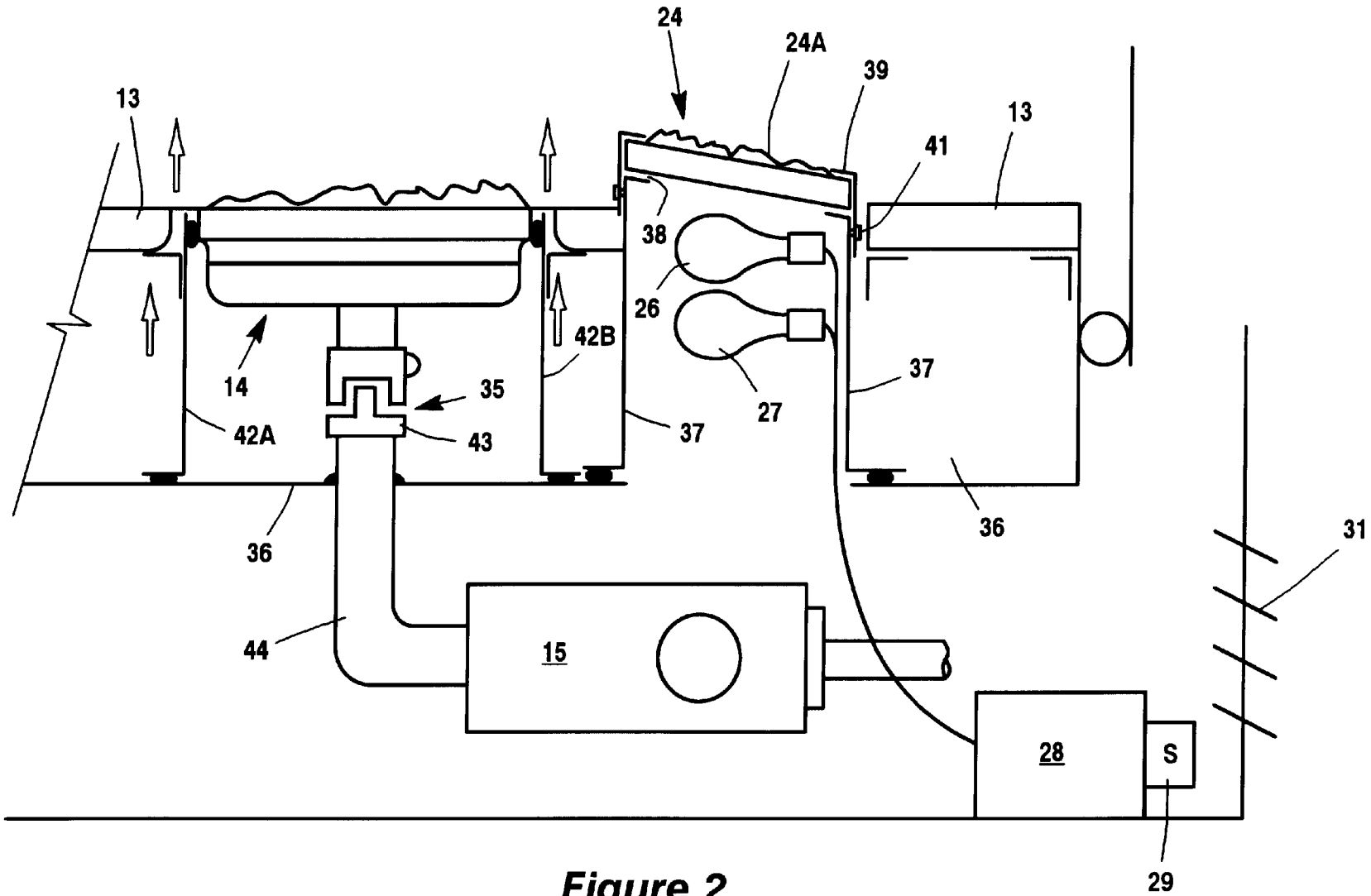
FIG. 2 is an enlarged detail of the ember support structure of the preferred embodiment of the present invention shown in FIG. 1.

Refer now to FIG. 2 showing in enlarged detail of the embers support structure. The bottom panel of the combustion chamber box is shown as a horizontal panel 36 used to support the floor 13, burner 14 and glowing embers structure 24A. A onepiece box assembly 37 is provided with a rectangular opening 38 over which is placed the glowing embers panel 24. The panel 24 is held in place by a clamp frame 39 and screws 41. Legs 42A and 42B are shown supported from the bottom panel 36 and provided with protruding flanges for supporting the burner 14 and the panel false floor 13. The burner 14 is provided with an air shutter valve 35 and an orifice 43 coupled to a gas supply tube 44 which connects to the control valve 15. The flickering light source 26 and optional light source 27 is shown connected to the control box 28.

When a pattern is painted on one side of panel 24 or is provided by inundations 24A on the panel 24, this pattern is projected by the light 26, 27 onto the logs 16 so as to simulate burning of the logs though no heat or flames are provided by the burner 14.

Figure 3:
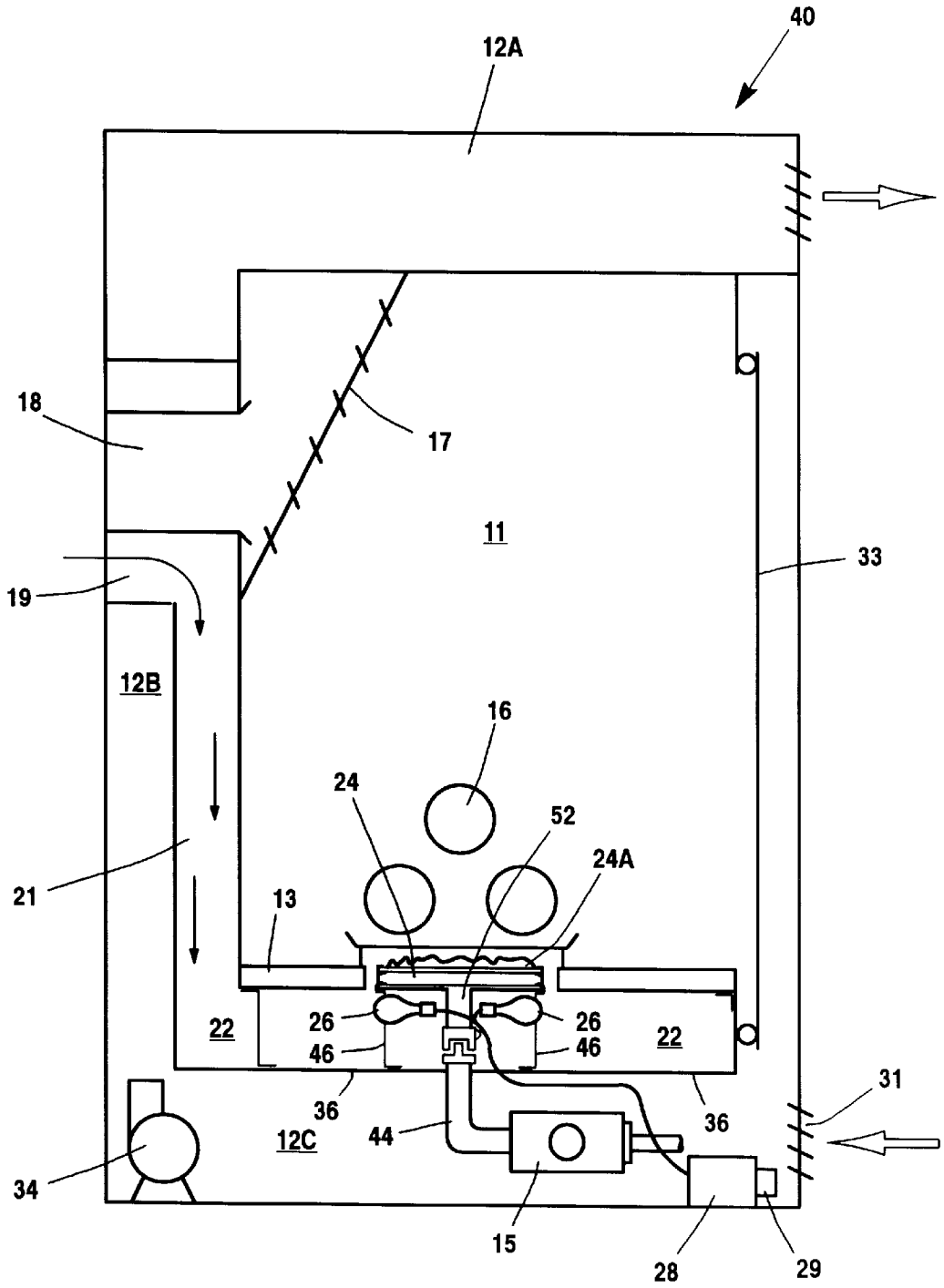
FIG. 3 is a side elevation in section of another preferred embodiment of the present invention showing a simulated glowing electric embers structure.

Refer now to FIG. 3 showing a fireplace 40 in side elevation and section showing another preferred embodiment of the present invention having a simulated glowing embers panel 24. The numerals used in FIGS. 1 and 2 which are the same as those shown in FIG. 3 represent the identical structure and do not require additional explanation. It will be noted that the glowing embers panel 24 is larger than the previous glowing embers panel, but is also provided with a 3-dimensional contoured pattern 24A on top of a panel 24 through which the flickering light source 26 may be projected onto the logs 16. In this embodiment, the light source 26 may include bright lights 27 which are not shown. The larger panel or glowing embers structure 24 is shown supported by legs 46 connected to the bottom panel of the combustion chamber 36.

Figure 3A:
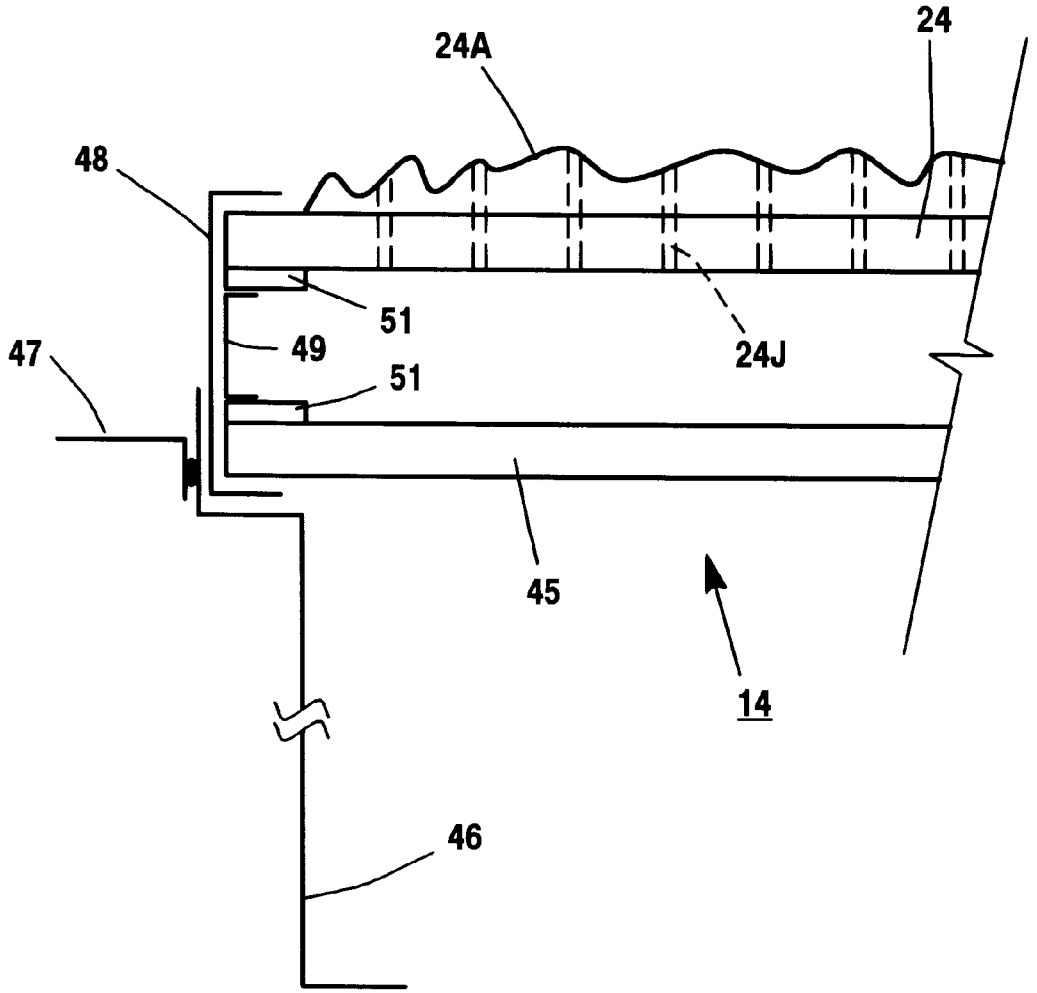
FIG. 3A is an enlarged detail of the ember support structure of FIG. 3.

Refer now to FIG. 3A showing an enlarged detail of the glowing embers support structure. In this embodiment, the burner 14 now comprises the panel 24 of translucent glass and a panel 45 of transparent glass separated by a gas manifold or plenum space. The gas supply tube 44 is coupled to burner tube 52 which connects into the center of the burner 14. There is shown a leg 46 welded to a channel shaped keeper 48 which supports the novel burner 14. The keeper 48 embraces the glowing embers panel 24, a spacer 49 and a pair of gaskets or resilient seals 51 are supported from the transparent glass panel 45. In the preferred embodiment shown, the leg 46 is further provided with a floor support flange 47 for positioning the false or raised floor 13 to a proper height.

In the modified embodiment shown in FIG. 3, the light source 26, 27 is positioned inside of the combustion air plenum 22 where the temperature of the air in the plenum 22 is maintained at approximately 200° F.–250° F. This temperature is sufficient to maintain the burner 14 and the light source at a sufficiently low temperature to ensure longevity.

Figure 4:
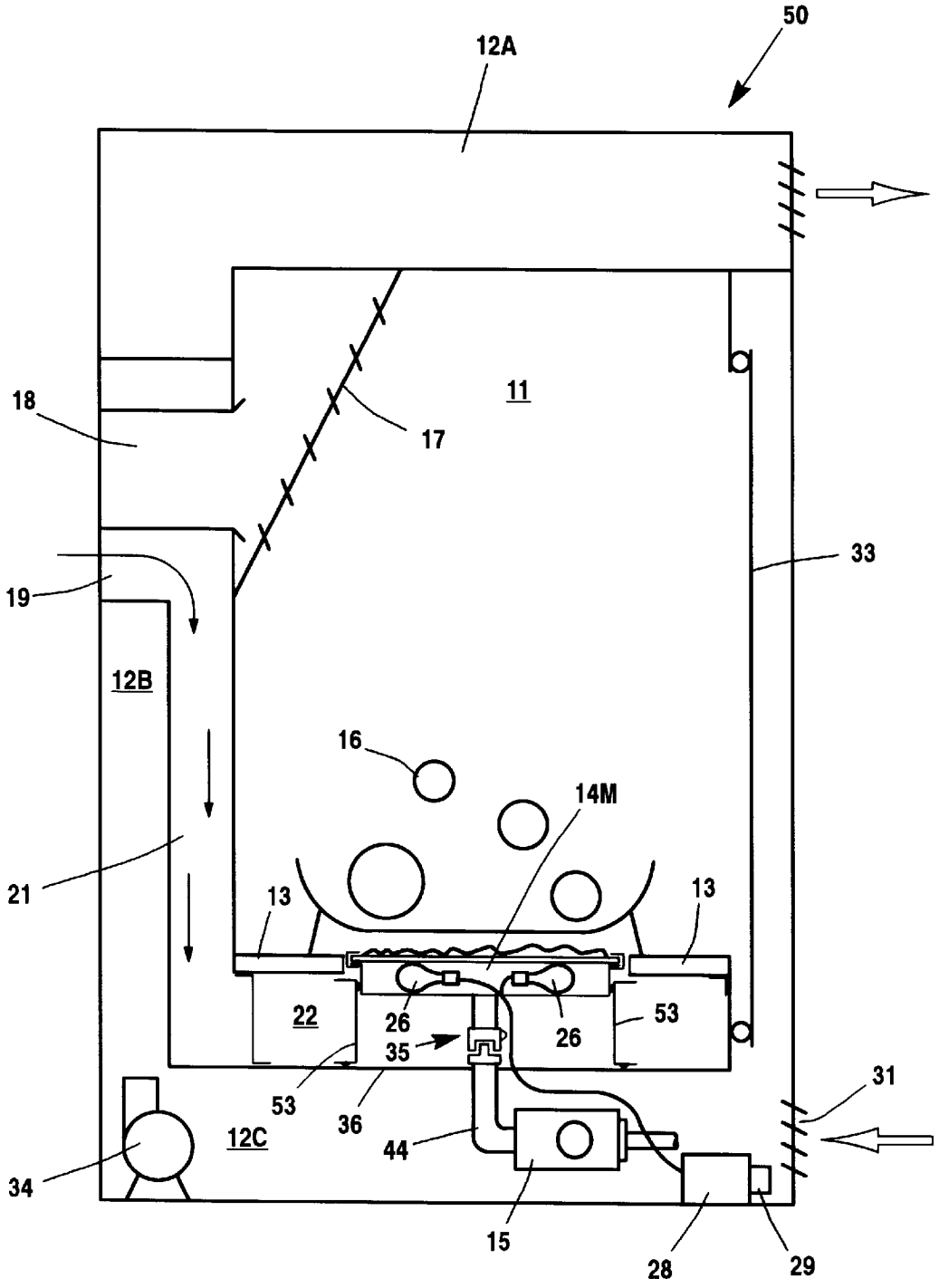
FIG. 4 is a side elevation in section of another embodiment of the present invention simulated glowing electric embers.

Refer now to FIG. 4 showing a slide elevation in section of another embodiment of the present invention simulated electric glowing embers structure. In this embodiment, the numerals used on the fireplace 10 and 40 which are the same as those shown on the fireplace 50 are identical or substantially identical and operate in the same mode of operation and need not be explained in detail hereinafter. Fireplace 50 is provided with a burner 14 that is deep enough to include the flickering light source 26. The burner 14 which contains the light source 26, 27 is supported from the bottom panel 36 by legs 53.

Figure 4A:
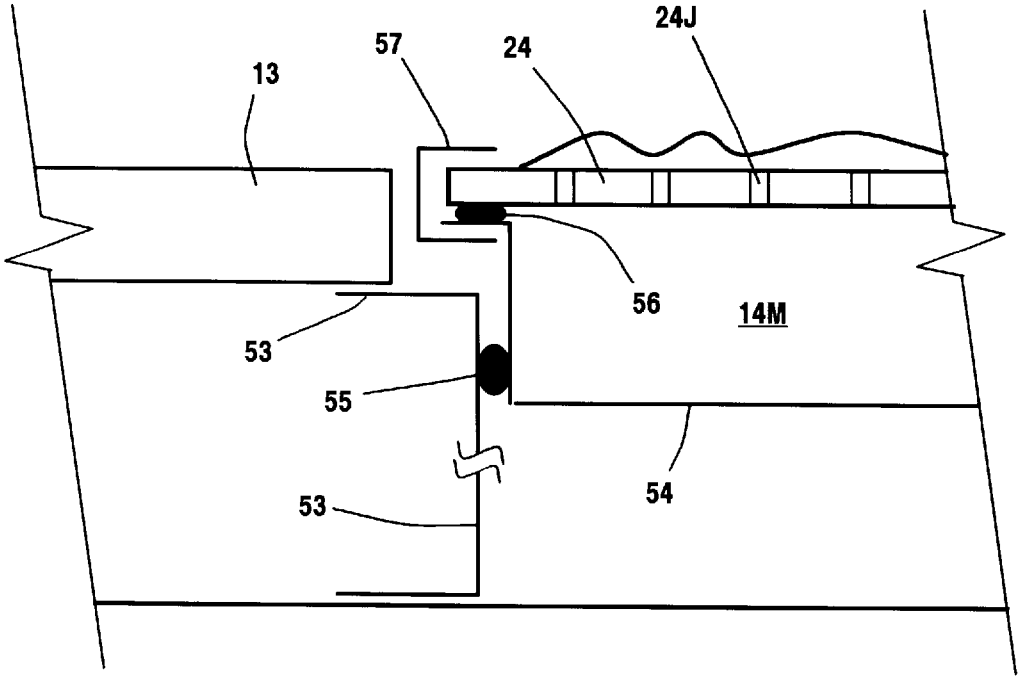
FIG. 4A is an enlarged detail of the embers support structure of the invention shown in FIG. 4.

Refer now to FIG. 4A showing an enlarged detail of the glowing embers/burner support structure of the embodiment shown in FIG. 4. In this embodiment the burner 14 comprises an upper panel 24 of glowing embers having a pattern 24A deposited thereon and burner jets 24J, therein which communicate with the manifold 14M in the center of the burner 14. The burner also comprises a metal pan 54 which is supported by legs 53 welded at weld 55 to the pan 54. Upper horizontal flanges 53R are provided on the legs 53 to support the false floor 13. A horizontal flange on the upper portion of pan 54 supports a gasket or seal 56 which in turn supports the glowing embers panel 24. The burner is assembled and kept in place by a keeper 57 which connects under the flange of the burner pan 54 and on top of the panel 24. In this embodiment, the burner temperature and the source of flickering light may reach temperature as high as 450°, thus a high temperature light source must be provided in the burner 14 in this embodiment.

Figure 5:
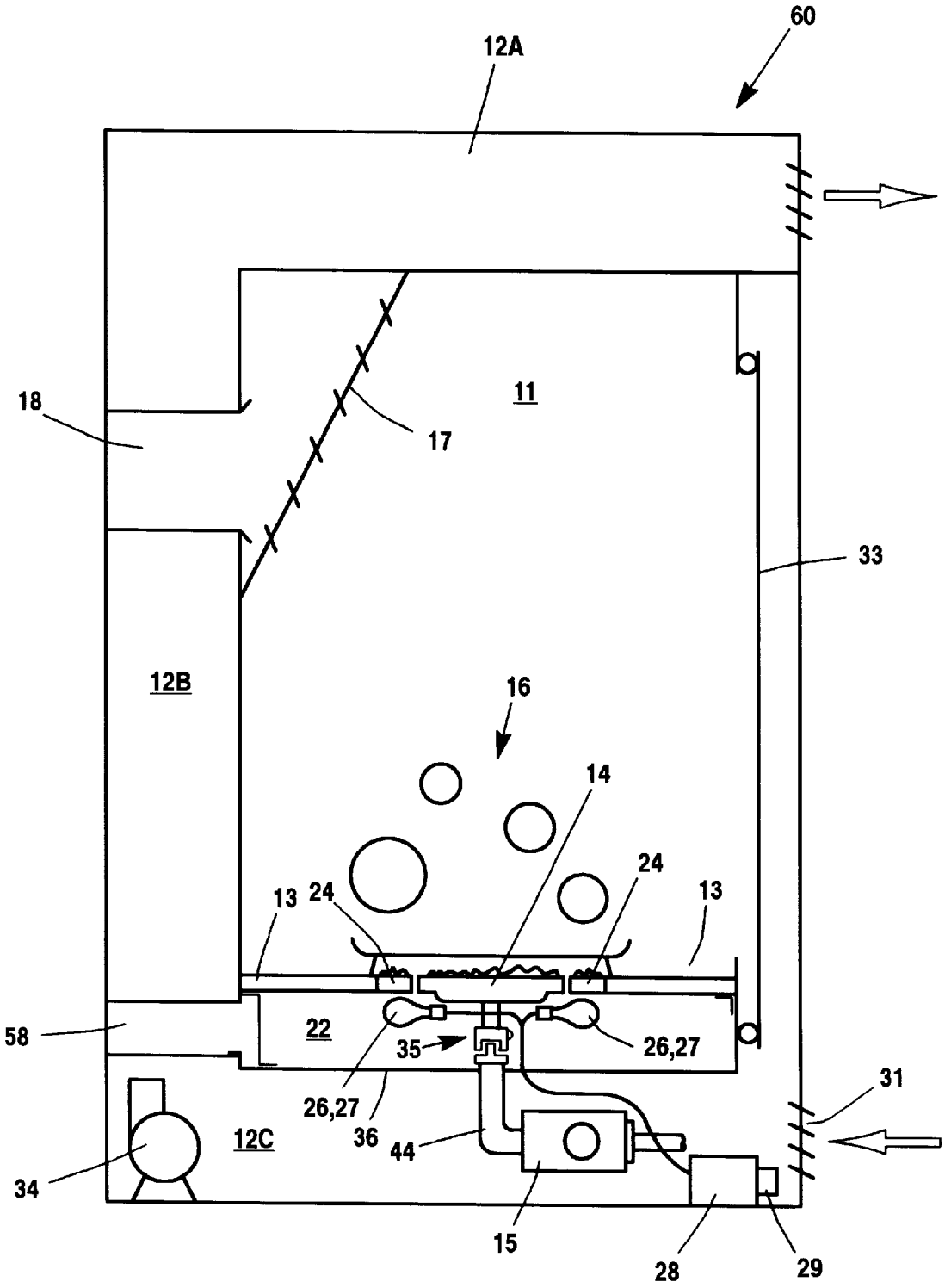
FIG. 5 is a side elevation in section of yet another embodiment of the present invention showing a dual random placement of the novel bed of coals or electric glowing embers.

Refer now to FIG. 5 showing a side elevation in section of a modified embodiment of the invention shown in FIG. 1 in which a pair of the novel bed of electric glowing embers 24 are shown at the front and rear of the log set 16. In this embodiment, the fireplace 60 is shown having a collinear air duct which provides a source of outside fresh air to the combustion air plenum 22. By providing outside cool fresh air into the plenum 22, the flickering light source 26, 27 may be maintained at a temperature no greater than 250° F. temperature. It will be understood that the burner 14 in FIG. 5 may be a flat pan burner of the type shown in FIG. 1 or any modification thereof. Further, the electric glowing ember panels 24 with glowing ember patterns 24A are made substantially identical to those explained in FIG. 1. In this embodiment, the light source projects a pattern of random flickering light onto the log set 16 which is non-repetitive in a manner which simulates real gas flames whether or not the gas flames are present.

Figure 6:
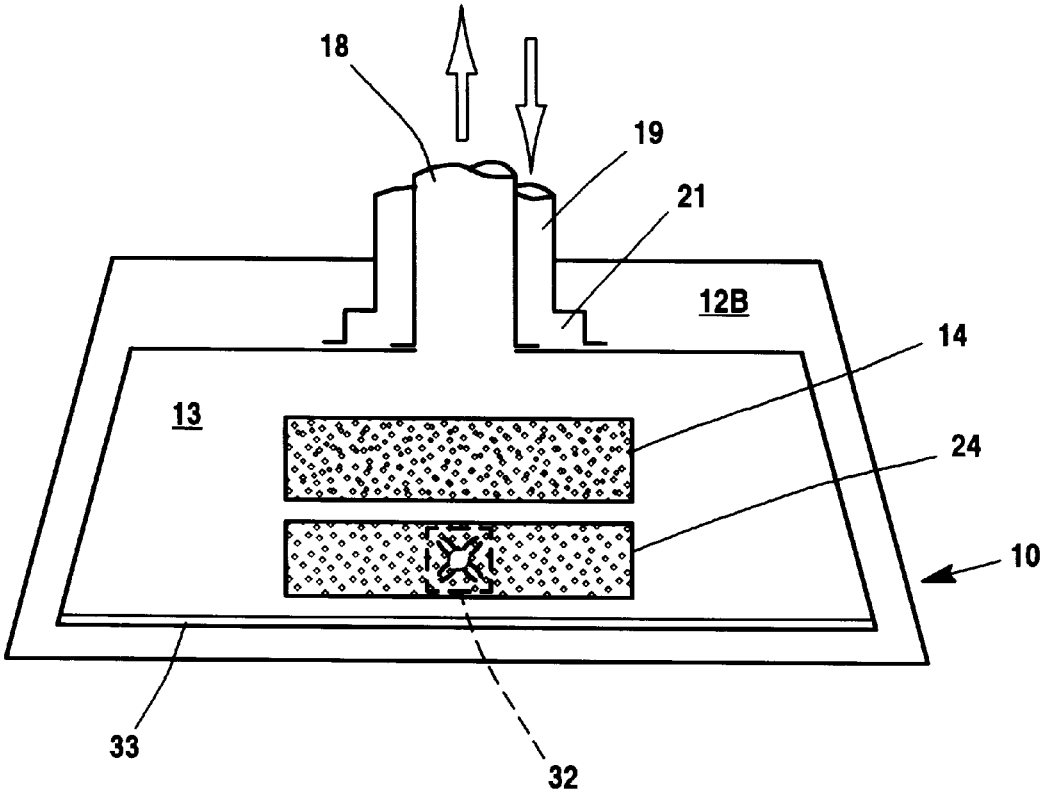
FIG. 6 is a top or plan view in section taken through the structure of FIG. 1 showing the position of the glowing embers and gas burner.

Refer now to FIG. 6 showing a top or plan view in section taken through the exhaust stack of the fireplaces shown in FIGS. 1, 3, 4, 5 with the log set 16 removed. The fireplace 10 is shown having a rectangular shaped electric glowing embers panel 24 which is placed over the electric fan 32 to provide the cooling of the light source (not shown). Inside of the fireplace 10 is shown the raised floor 13 of the combustion chamber which is provided with rectangular openings to receive the burner 14 and the panels 24. For purposes of completing an explanation of the type of fireplace shown with the preferred embodiment, a direct vent fireplace having an exhaust outlet 19 centered inside of a coaxial air supply duct 19, 21 is provided.

Having explained a preferred embodiment of the present invention, it will now be understood that the novel translucent glowing embers panels 24 are preferably provided with 3-dimensional glowing embers on the top surface. Further, the pattern which is projected by the light source 26, 27 may be painted onto the top surface employing a high temperature clay color paint or may be provided by placing a preprinted pattern or template underneath the panel 24. In either event, the light source 26, 27 causes the translucent panel 24 to glow and simulate glowing embers while simultaneously allowing transmitted light to reach the log set 16 and simulates flames by the projected light of the flickering light source. By employing panels made of high temperature clear or translucent glass, the present invention has been able to combine a glowing embers effect with flickering light to provide a new and substantially enhanced simulated fireplace without convection or radiation heat for use in hot climates without heat or as a conventional fireplace with heat.

A feature of the present invention permits the fireplace to be operated in a heating or a non-heating mode or somewhere inbetween. When used in crowded rooms, the heat may be reduced and the simulated electric fire and embers increased so that a desired uniform temperature is maintained by a central heating system.

What is claimed is:

1. Apparatus for electrically simulating burning logs and glowing embers in a fireplace comprising, a fireplace box of the type having a log set supported in a combustion chamber, said combustion chamber having a raised floor in a combustion chamber box, a translucent glowing embers panel mounted at the floor at a point below said log set, a direct source of flickering electrical light mounted below said translucent glowing embers panel for directly protecting a changing electrical intensity flickering light through said translucent panel, and simultaneously illuminating said log set and said glowing embers panel with the direct flickering light to effect a simulated bed of glowing embers and burning logs without reflection losses.

2. Apparatus as set forth in claim 1 which further includes:

a glowing embers pattern on said translucent glowing embers panel, said source of flickering light further comprising means for projecting said glowing embers pattern onto said log set.

3. Apparatus as set forth in claim 2 wherein said glowing embers pattern comprises a painted surface on said translucent panel of glowing embers.

4. Apparatus as set forth in claim 3 which further includes a source of non-flickering light for projecting said glowing embers pattern onto a log or logs of log set at increased intensity.

5. Apparatus for electrically stimulating burning logs and glowing embers in a fireplace comprising, said fireplace comprises a gas burner mounted in said raised floor of said combustion chamber, a fireplace box of the type having a log set and a combustion chamber, said combustion chamber having a raised floor in a combustion chamber box, a translucent glowing embers panel mounted at the floor at a point below said log set, said translucent glowing embers panel comprising a top surface of said gas burner, a source of flickering light mounted below said translucent glowing embers panel for projecting a changing intensity flickering light source through said translucent panel, and simultaneously illuminating said log set and said glowing embers panel to effect a simulated bed of glowing embers and burning logs.

6. Apparatus as set forth in claim 5 wherein said gas burner further comprises a pan type burner having a glass bottom pan connected to said translucent glowing embers panel forming a burner plenum therebetween, and said source of flickering light being mounted below said translucent glowing embers panel so that the flickering light passes through said glass burner.

7. Apparatus as set forth in claim 5 wherein said glass burner further comprises a pan type burner having a metal bottom pan connected to said translucent glowing embers panel forming a burner plenum therebetween, and said source of flickering light being mounted in said plenum.

8. Apparatus as set forth in claim 1 wherein said translucent glowing embers panel comprises a high temperature ceramic glass panel.

9. Apparatus as set forth in claim 8 wherein said translucent glowing embers panel comprises a ceramic glass top surface of a gas burner resistant to temperature in excess of 1,000° F.

10. Apparatus as set forth in claim 8 which further includes means for cooling a bottom surface of said translucent glowing embers panel and said high temperature ceramic glass panel comprises low heat temperature glass resistant to temperature up to 550° F.

11. A method for electrically simulated burning logs and glowing embers comprising the steps of:

providing a fireplace of the type having a log set in a combustion chamber box, providing a raised floor in the bottom of said combustion chamber box, inserting a translucent glowing embers panel in said floor at a point below said log set, mounting an electrical light device having a flickering source of light below said translucent glowing embers panel, directly projecting said source of flickering light from said device through said translucent panel, and illuminating said translucent glowing embers panel and simultaneously projecting a flickering light source onto said log set without reflection losses.

12. A method as set forth in claim 11 which further comprises the steps of projecting non-flickering light from a second light source through said glowing embers panel and onto said logs in said log set.

13. A method as set forth in claim 11 which further comprises the step of projecting a pattern of glowing embers onto logs of said log set.

14. A method as set forth in claim 13 which further comprises attaching a pattern of glowing embers onto one of the surfaces of said bed of glowing embers panel for projection of said pattern onto said logs in said log set.

15. A method as set forth in claim 14 which further includes a step of controlling the intensity of said flickering light.

16. A method as set forth in claim 11 which further includes the step of producing a random source of flickering light below said translucent glowing embers panel.

17. A method as set forth in claim 16 which further includes the step of producing a source of non-flickering light below said translucent panel, and controlling the brightness of said pattern of glowing embers being projected through said translucent panel onto said logs in said log set.

* * * * *